United States Patent [19]

McIntyre et al.

[11] 4,204,918

[45] May 27, 1980

[54] ELECTROPLATING PROCEDURE

[75] Inventors: James A. McIntyre; Robert F. Phillips, both of Midland; Joseph D. Lefever, Bay City, all of Mich.

[73] Assignee: The Dow Chemical Company, Midland, Mich.

[21] Appl. No.: 26,861

[22] Filed: Apr. 4, 1979

Related U.S. Application Data

[63] Continuation-in-part of Ser. No. 939,597, Sep. 5, 1978, abandoned.

[51] Int. Cl.[2] ..... C25D 7/00; C25D 7/04

[52] U.S. Cl. ..... 204/24; 204/26

[58] Field of Search ..... 204/11, 24, 26

[56] References Cited

U.S. PATENT DOCUMENTS

| | | | |
|---|---|---|---|
| 3,287,169 | 11/1966 | Rogers | 204/11 |
| 3,407,125 | 10/1968 | Fehlner | 204/20 |
| 3,539,469 | 11/1970 | Schroeder et al. | 252/474 |
| 3,616,286 | 10/1971 | Aylward et al. | 204/24 |
| 3,787,244 | 1/1974 | Schulmeister et al. | 427/115 |
| 4,053,371 | 10/1977 | Towsley | 204/11 |

FOREIGN PATENT DOCUMENTS 921111 2/1973 Canada .

*Primary Examiner*—T. M. Tufariello

*Attorney, Agent, or Firm*—James H. Dickerson, Jr.

[57] ABSTRACT

A porous electroplatable body is interiorly electroplated and the like by: making an at least substantial initial capacity filling of all or at least a portion of the void spaces in the body with an appropriate electroplating or other deposit-releasing bath solution or other dispersion; effecting subsequent immersion of the bath-replete body in a non-plating or non-depositing electroconductive liquid media; then following these steps by application of plating current to and through the bath containing body whereupon the interior surfaces of the body are plated or coated.

15 Claims, 3 Drawing Figures

ELECTROPLATING PROCEDURE

CROSS REFERENCE TO RELATED APPLICATIONS

Figure 1:
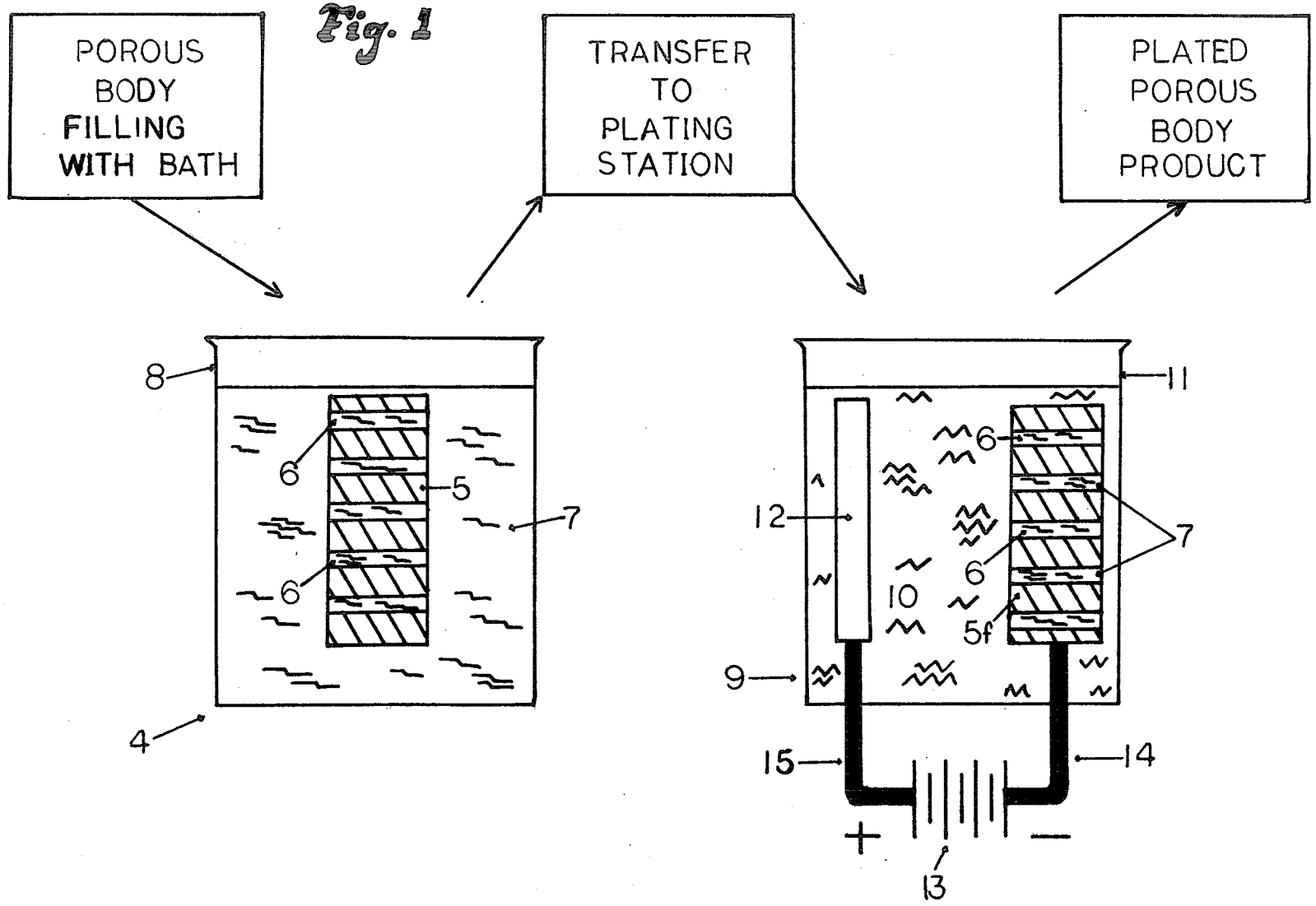

This application is a continuation-in-part of co-pending application Ser. No. 939,597, filed Sept. 5, 1978, now abandoned.

BACKGROUND OF THE INVENTION

Porous bodies are notoriously difficult to satisfactorily interiorly electroplate. The problem intensifies with increasing diminishment of the void spaces involved, about which the plating deposit is desired to be made on the enclosing wall surfaces thereof. This is particularly so in cases where the body to be interiorly plated is a porous electrode intended for usage electrochemically and, typically, containing an abundance of exceedingly fine, internal body-traversing pores, oftentimes of miniscule size on the order of 10 microns and less to as small as even 0.1 micron or so.

Frequently, as with electrodes, the plating is only wasted and not needed or wanted (and may even be deleterious) on the exposed faces of the porous body to be plated. Also, standard electroplating techniques tend to cause a build-up of plating deposit on the exterior surfaces of the porous bodies, especially around and about pore egress sites. This is often serious enough to engender pore blocking, a seriously disadvantageous, if not fatal condition, when electrodes are involved. Further, normal means utilized to interiorly plate porous bodies are not always effectively efficient in leaving only conservatively but adequately thin deposit layer(s) on the enclosed surfaces to be plated. This is economically objectionable or even defeating when plating expensive coatings, such as those laid of silver as are often made for catalytic effect on the more base and less costly metal bodies of porous electrodes for electrochemical applications.

Attempts to preclude or circumvent the mentioned handicaps and shortcomings have not met with general success. And, they often require resort to awkward and/or complicated procedures to avoid or minimize one or more of the indicated problems. For example, it has been proposed to pump plating both through the porous body to ameliorate laying of internal coatings, the implementation of such sort of operation being not easy or straightforward and also not entirely reliable for realizing desired attainments. Illustrative of previous efforts in the area of present interest are U.S. Pat. Nos. 3,359,469 and 3,787,244 plus Canadian Pat. No. 921,111.

FIELD AND OBJECTIVES OF THE INVENTION

The herein revealed invention resides in the electroplating field, being more directly relevant to the interior electroplating of various porous bodies, particularly finely pored structures including electrochemical electrodes, in such a way as to preclude or minimize the laying of the plate on exterior body surfaces and/or substantial or intolerably excessive pore blockage and to also achieve maximized proficiency and utmost economy and securement in adequately effective laid quantities of efficiently and uniformly thin and appropriately and desirably frugal plated layers on interior body surfaces; the attainment and provision of same being amongst the principal aims and objectives of the invention.

SUMMARY OF THE INVENTION

Practice of the present contribution to the art involves a procedure for providing internal surface deposit layers on the walls of void spaces in a porous electroconductive body comprising: at least substantially filling all or a portion of the void spaces in the porous body with a bath of a therein dispersed electrodepositable substance which forms deposite layers on an oppositely electrocharged body when subject to passage therethrough of a deposit-forcing electrical current; partially or completely immersing the bath-replete porous body in an electroconductive liquid medium that is different than the bath and which in itself contains substantially nothing of a deposit-releasing nature when the liquid is subject to passage of electrical current therethrough; then applying a direct electrical potential across the liquid and to said bath-replete body to cause current to flow through said liquid and body whereupon interior deposits are laid on the internal surface areas of said body from said bath occupying the void space therein.

Somewhat more definitively, the present invention provides an electroplating procedure for plating all or a portion of the internal surface areas of a porous electroplatable body comprising: at least substantially (if not completely) filling all or a portion of the void spaces in the porous body with an electroplate bath; partially or completely immersing the bath-replete body in a non-plating electroconductive liquid medium; then passing under applied voltage an electroplating current through said liquid medium and said bath-containing body to lay a plate deposit on the interior surface area of said body.

Salient particulars and significant specifics relevant to embodimentation of the invention are ingenuously delineated in the ensuing Specification and description.

ILLUSTRATED REPRESENTATION OF THE INVENTION

Figure 2:
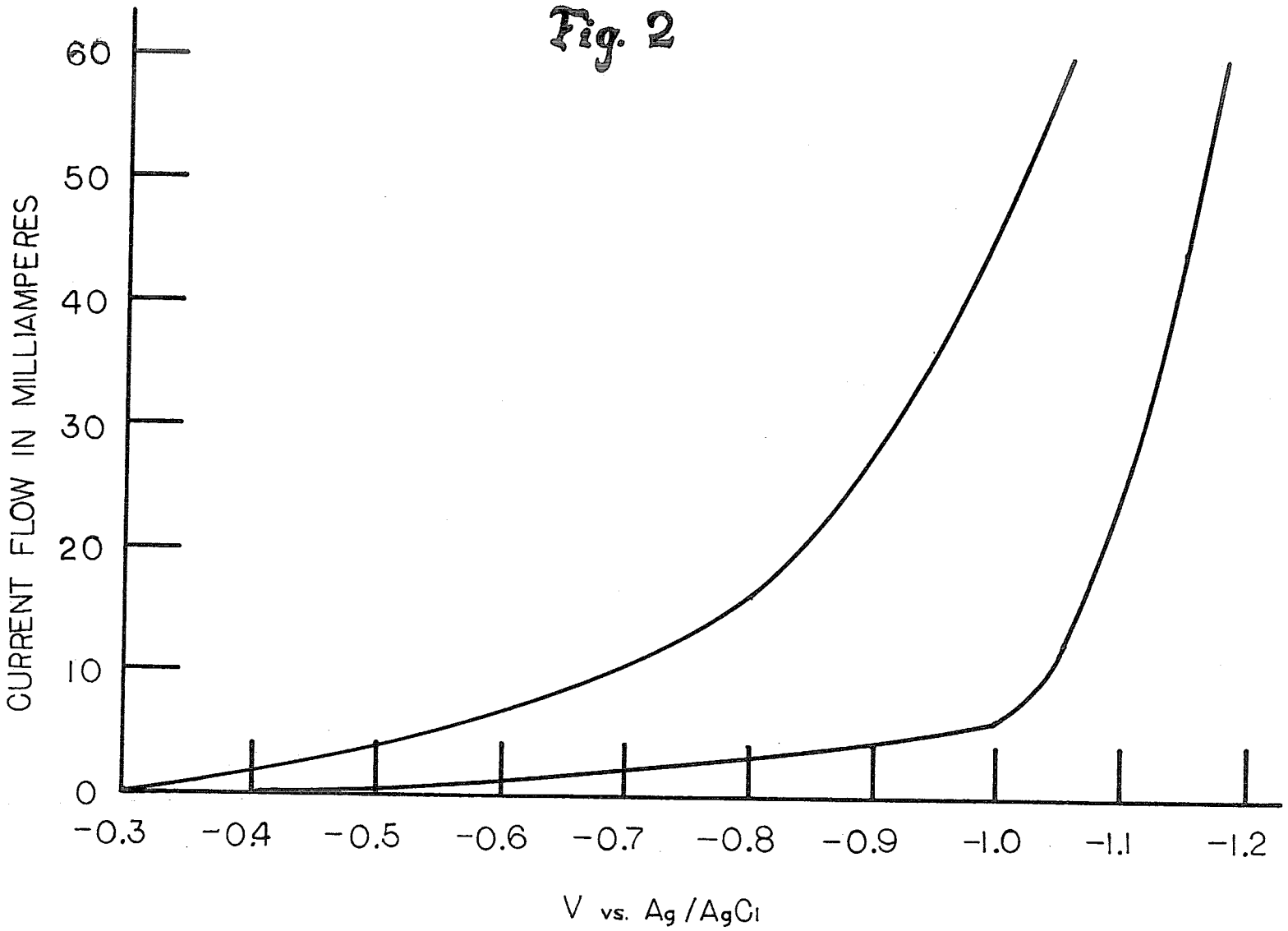
Figure 3:
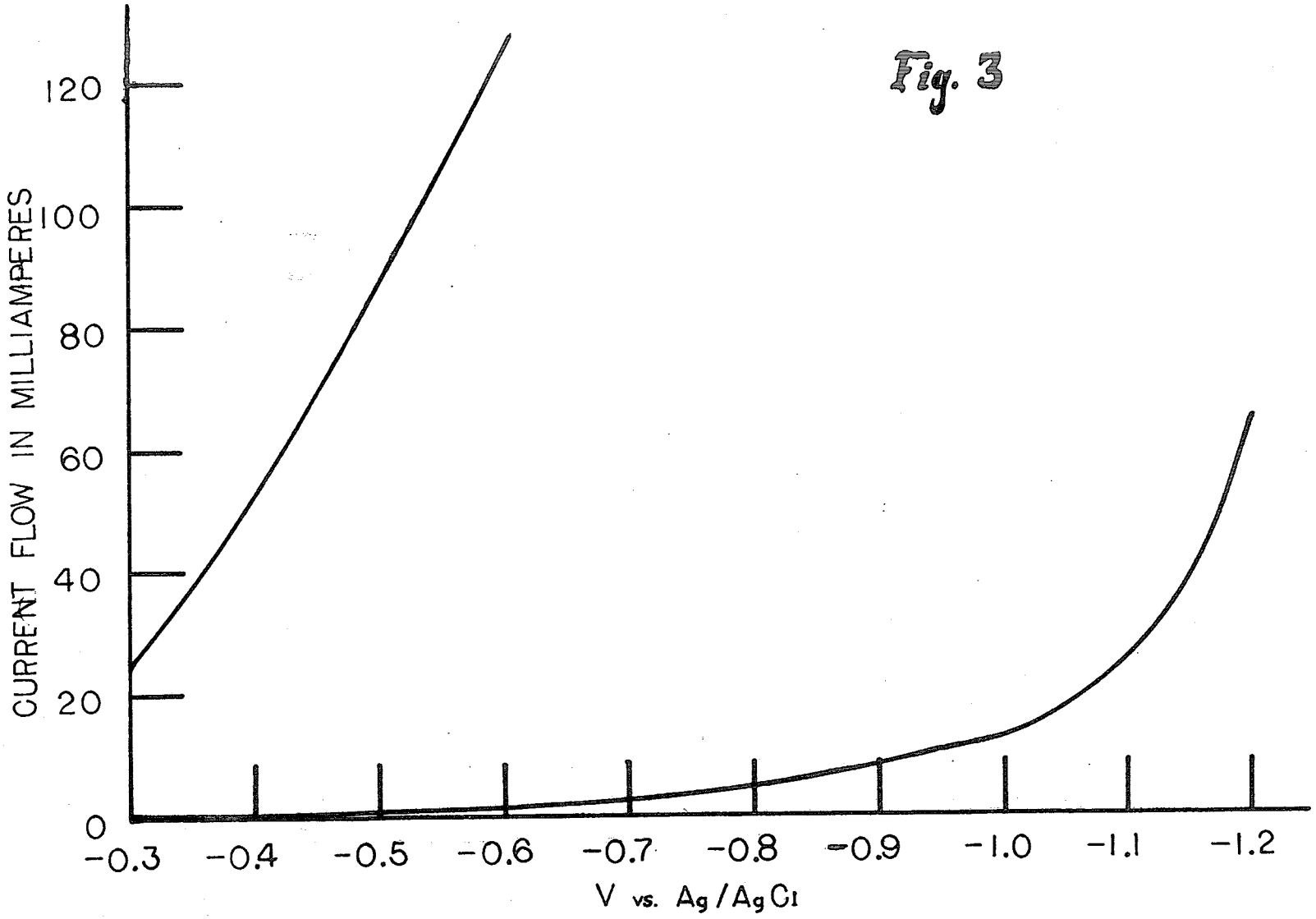

Further features and characteristics of the porous body electroplating development in accordance with the present invention, and the advancing way in which it so nicely achieves and fulfils the presently-intended aims and objectives and contributes to the art for which it is pertinent, are even more readily apparent and evident in the following Specification and description when taken in conjunction with the accompanying Drawing, wherein:

FIG. 1 is a flow-diagram and schematically fanciful sort of view which in a very simple style illustrates one procedure for implementing the invention; and FIGS. 2 and 3 are graphical presentations showing plots of experimental results obtained to demonstrate one valuable product of the invention.

PARTICULARIZED DESCRIPTION OF THE INVENTION

According to the procedure of the present invention on its conceptual and most fundamental basis, porous electroplatable bodies are interiorly plated solely by providing substantially, if not completely, all of the volume of plating bath from which the plated coating is to be laid within all or a portion of the internal voids of the body during the time that plating current is applied to effectuate the desired plate deposit on the wall surfaces of the internal voids in the involved bodies. In this way, an efficacious yet sparing plating application is made on essentially only the desired places inside of the body with generally good uniformity and quality thereabout. At the same time, exterior surface plating is minimized, if not avoided, as is pore blockage propensity associated therewith. The latter phenomenon, as mentioned, can be seriously problematical when finely pored bodies, such as porous electrodes, are involved.

Practice of the invention produces its very advantageous and beneficial results as a consequence of its unorthodox departure from standard and normally conventional electroplating methods.

Thus, in conventional electroplating the article to be plated is placed in a solution which contains the ion of the metal to be plated. Often, the anode is comprised of the same metal as is to be laid into electroplated deposit; as when silver plating systems use silver anodes in their arrangment. This materially helps to keep a constant concentration of metal ions in solution through anode dissolution as metal ions plate out on the cathode. Since metal ion migration into the interstices of a porous body is relatively slow, being aggravated with decreasingly small pore sizes, the concentration of metal ions within the body voids decreases with time during the plating as compared to that in the main body of the plating bath. Unavoidably, the comparable plating rate then at least seemingly accelerates or in any event goes increasingly relatively much faster (causing heavier plating effects) on the exterior body surfaces where metal ions in the bath, per se, are in proportionally greater abundance. The difficulties thereby created are those overcome by use of the procedure of the present invention.

With reference now to FIG. 1 of the Drawing, there is shown in an elementary demonstrative fashion one way of carrying out the procedure of the present invention. An electroplatable, generally metallic porous body 5 (such as a finely-pored electrode) is suitably pretreated, if necessary, to ready it for the plating operation. This may include chemical treatments, degreasing washing and other cleaning, drying, etc. Body 5 contains a plurality of internal voids 6 usually giving it a rather sponge-like structure, the enclosed surface walls of which voids are intended to be plated. The electrode is immersed at a filling station, designated generally by reference numeral 4, in an appropriate plating bath solution 7 held in a large-enough container 8 for the purpose.

The body 5 is preferably kept in the saturating bath until complete liquid filling of the void space(s) in the body is accomplished. When bodies with fine pores are being provided with a fill of the bath, such as porous electrode bodies, enough time should be allowed for the soak to permit adequate liquid penetration of and filling by the bath. Although shown is vertical immersion, it may sometimes facilitate getting the bath thoroughly into the body by having the body tilted in any most effective direction to minimize or avoid air entrapment in the body. For this, physical movement of the body and/or vigorous liquid circulation may also help achieve better and quicker filling. Incomplete or less than capacity void filling generally results in less than total surface plating within the body; even though in frequent cases and for many purposes it may suffice to have patchy or spotty deposit formations within the voids or pores.

If desired or preferred, other means of getting the bath into the voids may be resorted to, such as spray feeding or forced-filling manipulations.

Though not shown in the drawings, it should be understood that one may use the same procedure to plate the internal pores in only a portion of a porous body. To do so, one could fill the desired portion of the pores in the body and proceed with the procedure as outlined herein. For instance, one may want to electroplate the pores in only the lower half of a porous body. In such case, he should fill the pores in only the lower half of the porous body before proceeding with the procedure.

There are several techniques which may be used to fill the internal pores in only a portion of the porous body. For example, one may apply a gas or a non-plating solution to one side of the electrode while applying the plating solution to the other side of the porous body. By varying the pressure of each, one may selectively control the proportion of voids which are filled with plating solution and, thus, subsequently plated.

The porous body 5 may be of any desired electroplatable material depending on the particular article to be plated and its associated utility. Porous electrode bodies are frequently fabricated from such metals as iron, steel alloys (particularly the corrosion-resisting or so-called "stainless steel" types) copper and titanium; although there obviously is no limitation to these metals for electrodes or any other bodies to be plated.

And, likewise, depending on the substrate to be plated and the coating deposit to thereon be laid, any suitable plating solution may be employed.

In fact, and insofar as concerns competent comprehension of what is needed and appropriate for reduction to practice of the instant revealation, the basic fundamentals, operational principles and limitations of and materials for eletroplating are so widely comprehended by those skilled in the art that further repetitive elucidation thereof and merely cumulative elaboration thereon is unnecessary for thorough understanding and recognition of best modes of and means for implementing the development of the present invention. In substantiation of this, reference may be had to such publications as "Modern Electroplating", 3rd Edition, F. A. Lowenheim, Ed., John Wiley and Sons, Inc., N.Y. (1974) and "Modern Inorganic Chemistry" by F. A. Cotton and G. Wilkinson, John Wiley and Sons, Inc., N.Y. (1972).

After its capacity (or less than) fill, the bath-replete body 5 is tranferred from the filling station 4 to a subsequent plating station, generally designated by the reference numberal 9. Care should be taken in this move to prevent or minimize if not entirely avoid loss, leakage or spill of bath from body voids 6. Holding the body in optimum disposition against leakage when taken out of the liquid bath medium may help prevent this. In some cases, covers held closely against pore openings on exposed surfaces may also be beneficial to prevent or minimize spill of each from the filled body. Relatively fine pored bodies, such as electrodes, usually are not too troublesome to manipulate without bath spilling when they are outside a liquid atmosphere.

At plating station 9, there is contained in a suitable vessel 11 a volume of (essentially) non-plating, electroconductive liquid 10. It is generally satisfactory for the current-carrying liquid 10 to be an appropriately formulated aqueous saline solution, i.e., one containing enough of some suitable and compatible ionizable salt that does not react with the plating bath and is adapted to adequately transport the electrical current necessary for plating. In other words, the liquid 10 is intended to more or less function as a fluid electrical brush for the body 5 to be interiorly plated; and it should be substantially if not entirely free from reducible ions that would tend to interfere with the desired internal plating procedure.

Inside vessel 11 there is an anode 12 and means (not shown) to receive and mount the bath-replete body 5*f* and make an electrical connection therewith, as through bus bar or electric line 14 going to a suitable direct current power source 13 which, in turn, is connected at opposite polarity to the anode 12. It is usually preferred to completely submerge bath-replete body 5*f* in liquid 10 for the plating, although there are circumstances when only partial immersion will suffice and be permissible due to the fact that the plating bath is already where it is wanted in the body being plated.

It is necessary that the electrode counter to the body being plated (which, as is primarily described, is anodic although that is not necessarily the case) be inert. In other words, the counterelectrode should not dissolve so as to yield platable ions in the electroconducting solution employed. Instead, it should be selected so as to be capable of allowing for gas evolution or some other non-interference-provoking reaction in the process.

A plating current is then (and thereby) applied to lay the desired interior deposit from bath 7 within the void spaces or pores 6 of the filled body 5*f*. Advantageously current level applied through liquid 10 for a long-enough time period to accomplish the plating purpose is relatively lower as compared to that used in conventional electroplating; the reduction generally being such that current rate in practice of the present invention is only from about 5 to 40 percent, oftentimes with advantage only about 10 percent, of normally utilized electroplating currents in standard systems attempting to lay the same plating deposits on the same stustrates. However, there is a time factor involved. Enough current density should be utilized to get the plating done quickly enough so as to minimize or avoid excessive diffusion, if any whatsoever, of bath 7 into liquid 10 and vice versa, during the plating interval.

While optimum current density to employ will obviously vary from system-to-system and with different given bodies to be interiorly plated and particular plate deposit levels wanted to be gotten, it is usually desirable to so operate, during plating that effected current density is at least about 0.05 amp/in$^2$ (ca. slightly less than 0.008 amp/cm$^2$). Current at levels too much lower than this may require too much plating time to finish the job giving too much opportunity for deleterious bath/liquid inter-diffusion and mixing. Upper acceptable limits of current density levels are at the point where intolerably excessive formation and evolution of hydrogen may occur at and from the body being plated. For many purposes, a current density in the neighborhood of 0.1 amp/in$^2$ (ca. 0.015±amp/cm$^2$) is found satisfactory, even though the precise level to employ for any given situation is readily determinable by any artisan upon simple testing.

After the plating, the plated porous body product is removed from the liquid 10 and then given any washing, drying or other post-plating treatment needed. It is then ready for any appropriate usage for which it was prepared or to which it is adaptable.

In some instances and under certain capability circumstances, the quantity of plate laid in a single-pass conduction of the procedure may and for various reasons be found to be not adequately yielding of desired or required plating levels. In these situations there is no problem in getting finally desired plating deposit levels by mere repetition of the procedure with as many multiple fill and plating sequences, with intermediate washings, etc., for as many times as expedient or necessary to achieve wanted results.

Of course, even though single body handling at a given time is described for demonstrative purposes in the foregoing Specification, it is obvious that a plurality of porous bodies to be plated may be simultaneously handled in given installations in practice of the procedure of the present invention.

EXEMPLIFICATION AND APPLICABILITY ILLUSTRATION OF THE INVENTION

To demonstrate the advantageous practice of the present invention, a flat, disc-like body of porous nickel having a 2½ inch (ca. 6.35 cm) diameter was washed thoroughly with acetone and air dried at about 110° C. The porous body (made of commercial pressed and sintered powdered nickel electrode stock obtained from GOULD, Inc., of Cleveland, Ohio) had a thickness of 70 mils (ca 0.178 cm) and an average pore hole size of 10 microns diametric. It had a porosity of 80 percent by volume.

The porous body was then saturated in an aqueous plating bath solution containing 50 g/l AgCN (silver cyanide) and 100 g/l KCN (Potassium cyanide). The bath-filled body was then placed as the cathode in an electrolytic cell containing as the current carrying liquid a 1/10th molar (0.1 M) aqueous solution of sodium per chlorate ($NaClO_4$) and a platinum (Pt) anode. Current at 0.1 amp/in$^2$ was passed for 30 minutes to lay a silver plate deposit on the inner pore walls of the nickel body. The intended application of the plated body was employment as an oxygen depolarized cathode in a chlor-alkali electrolysis cell.

To demonstrate the efficacy of the obtained plating, the catalyzed electrode product was tested in an experimental cell along with an unplated specimen of the same porous nickel stock.

Each of the specimens was thus separately used as an electrode by being mounted for evaluation as a depolarized cathode in a standard test cell having an expanded titanium mesh anode coated with a oxide including titanium and ruthenium. Anode-to-cathode spacing was 9/32 inch (ca. 0.714 cm) with an intermediate "Nafion" (DuPont TM) ion exchange membrane separator in the cell. The anolyte was 300 g/l NaCl and the catholyte 100 g/l NaOH; with the cell operated at a temperature of about 60° C. and gas pressure on the back side of the cathode maintained between 2 and 2-½ psig.

The applied current density was 0.5 amp/in$^2$.

Such testing allows one to determine upon performance the measure over increasing time periods of the voltage savings realized in the comparisons between operation with both nitrogen and oxygen gases applied to the electrode. The difference(s)—by subtraction—between voltage values obtained from nitrogen (i.e., inert gas) operation at any given point of measure and those from oxygen (i.e., active gas) operation at the same point of measure provide(s) reliable indication of voltage savings obtainable with and corresponding depolarization effect experiences upon use of the electrode as a cathode.

The excellent results obtained are graphically depicted in the comparative performances exhibited in the accompanying FIGS. 2 and 3 of the Drawing, with the first showing uncatalyzed porous nickel performance as a depolarized cathode and FIG. 3 showing that obtained with the nickel body catalyzed in accordance with a practice of the present invention.

The fine performance realized, as shown in this presentation evidences the very good plating results achieved by the present procedure.

Analogous and commensurate excellent and surprisingly good results are obtainable with other porous bodies when employed in other electroplating systems and for other electrochemical and diverse purposes.

It must be considered and given full significance and weight that the present invention is, and is so conceived and intended to be, applicable to and may be practiced for the obtention of other equivalent and corresponding deposits of other than plain metal materials such as may be done and realized when utilizing other of the known coating substances that may even be organic in nature but are electro-depositable from appropriate solutions and suspensions following modes and schemes analogous to those involved in electroplating. This is notwithstanding the foregoing description and expostulation that has been couched and put forth in terms and phraseologies generally coincident with and peculiar to the electroplating art.

Many changes and modifications can readily be made and adapted in embodiments in accordance with the present invention without substantially departing from its apparent and intended spirit and scope, all in pursuance and accordance with same as it is set forth and defined in the hereto appended Claims.

What is claimed is:

1. Procedure for providing internal surface deposit layers on the walls of void spaces in a porous electroconductive body comprising:

at least substantially filling the void space in the porous body with a bath of a therein dispersed electrodepositable substance which forms deposit layers on an oppositely electrocharged body when subject to passage therethrough of a deposit-forcing electrical current;

immersing the bath-replete porous body in an electroconductive liquid medium that is different than the bath and which in itself contains substantially nothing of a deposit-releasing nature when the liquid is subject to passage of electrical current therethrough; then applying a direct electrical potential across the liquid and to said bath-replete body to cause current to flow through said liquid and body whereupon interior deposits are laid on the internal surface areas of said body from said bath occupying the void space therein.

2. Electroplating procedure for plating the internal surface areas of a porous electroplatable body comprising:

at least substantially filling void space in the porous body with an electroplating bath;

immersing the bath-replete body in a non-plating electroconductive liquid medium; then passing under applied voltage an electroplating current through said liquid medium and said bath-containing body to lay a plate deposit on the interior surface area of said body.

3. Procedure for providing internal surface deposit layers on the walls of void spaces in at least a portion of a porous electroconductive body comprising:

at least substantially filling the void space in a portion of the porous body with a bath of a therein dispersed electrodepositable substance which forms deposit layers on an oppositely electrocharged body when subject to passage therethrough of a deposit-forcing electrical current;

immersing at least the portion of bath-replete porous body to be plated in an electroconductive liquid medium that is different than the bath and which in itself contains substantially nothing of a deposit-releasing nature when the liquid is subject to passage of electrical current therethrough; then applying a direct electrical potential across the liquid and to said bath-replete body to cause current to flow through said liquid and body whereupon interior deposits are laid on the internal surface areas of said body from said bath occupying the void space therein.

4. Electroplating procedure for plating the internal surface areas of a portion of a porous electroplatable body comprising:

at least substantially filling void space in a portion of the porous body with an electroplating bath;

immersing at least the portion of the bath-replete body to be plated in a non-plating electroconductive liquid medium; then passing under applied voltage an electroplating current through said liquid medium and said bath-containing body to lay a plate deposit on the interior surface area of said body.

5. In the procedure of claims 2 or 4, electroplating a porous metallic electrode body having internal, body-traversing pores of an average diameter of less than about 10 microns.

6. A procedure according to the procedure of claim 5, wherein the electrode body is comprised of a metal selected from the group consisting of nickel, iron and its alloys including corrosion-resisting steels, copper and titanium.

7. In the procedure of claims 2 or 4, filling the body with an electroplating bath composed for plating of silver.

8. A procedure according to the procedure of claim 7, wherein the electrode body is comprised of a metal selected from the group consisting of nickel, iron and its alloys including corrosion-resisting steels, copper and titanium.

9. A procedure according to the procedure of claim 7, wherein said bath is an effective plating mixture in aqueous solution of silver and potassium cyanides and said electroconductive liquid medium is an aqueous solution of potassium per chlorate.

10. In the procedure of claims 2 or 4, immersing said body in an aqueous non-plating, electroconductive liquid medium for passage of the electroplating current.

11. In the procedure of claims 2 or 4, passing said current through said electroconductive liquid medium at a density that is between about 0.05 amp/in$^2$ and that causing formation and evolution of hydrogen at and from the body being plated.

12. A procedure according to the procedure of claim 7, wherein the current is passed through the electroconductive liquid medium at a density that is between about 0.05 amp/in$^2$ and that causing formation and evolution of hydrogen at and from the body being silver plated.

13. A procedure according to claim 10, wherein said current density is on the order of about 0.1 amp/in$^2$.

14. Repeating the procedure of claims 1 or 3 through a multiple series of sequential plating and filling steps.

15. Repeating the procedure of claims 2 or 4 through a multiple series of sequential plating and filling steps.

* * * * *

UNITED STATES PATENT AND TRADEMARK OFFICE

CERTIFICATE OF CORRECTION

PATENT NO. : 4,204,918

DATED : May 27, 1980

INVENTOR(S) : James A. McIntyre, Robert F. Phillips, Joseph D. Lefevre

It is certified that error appears in the above-identified patent and that said Letters Patent are hereby corrected as shown below:

Title page, under Inventors, delete the name of "Lefever" and insert therefor --Lefevre--.

Col. 2, line 9, delete "deposite" and insert therefor --deposit--.

Col. 2, line 42, delete "advancing" and insert therefor --advancive--.

Col. 3, line 16, delete "arrangment" and insert therefor --arrangement--.

Col. 4, line 32, delete "eletroplating" and insert therefor --electroplating--.

Signed and Sealed this

*Twenty-fifth* Day of *November 1980*

[SEAL]

*Attest:*

SIDNEY A. DIAMOND

*Attesting Officer*

*Commissioner of Patents and Trademarks*